US009144366B2

(12) United States Patent
Oner

(10) Patent No.: US 9,144,366 B2
(45) Date of Patent: Sep. 29, 2015

(54) CONTAINER

(75) Inventor: Refik Oner, Parsippany, NJ (US)

(73) Assignee: RECKITT BENCKISER N.V., WT Hoofddorp (NL)

( * ) Notice: Subject to any disclaimer, the term of this patent is extended or adjusted under 35 U.S.C. 154(b) by 1087 days.

(21) Appl. No.: 12/864,782

(22) PCT Filed: Jan. 15, 2009

(86) PCT No.: PCT/GB2009/000099

§ 371 (c)(1), (2), (4) Date: Dec. 20, 2010

(87) PCT Pub. No.: WO2009/095638

PCT Pub. Date: Aug. 6, 2009

(65) Prior Publication Data

US 2011/0108154 A1 May 12, 2011

(30) Foreign Application Priority Data

Jan. 29, 2008 (GB) ..... 0801580.2

(51) Int. Cl.

| | |
|---|---|
| ***B65B 1/04*** | (2006.01) |
| ***A47L 15/44*** | (2006.01) |
| ***C11D 17/04*** | (2006.01) |

(52) U.S. Cl.

CPC ..... *A47L 15/4445* (2013.01); *C11D 17/041* (2013.01)

(58) Field of Classification Search

USPC ..... 141/1, 2, 18, 363–366; 222/54, 92

See application file for complete search history.

(56) References Cited

U.S. PATENT DOCUMENTS

| | | | | |
|---|---|---|---|---|
| 4,700,857 | A * | 10/1987 | Kittscher et al. | 215/232 |
| 6,223,937 | B1 | 5/2001 | Schmidt | |

FOREIGN PATENT DOCUMENTS

| | | | |
|---|---|---|---|
| DE | 19935728 | A1 | 2/2001 |
| DE | 10036850 | A1 | 10/2001 |
| DE | 102005004487 | A1 | 8/2006 |
| EP | 1247483 | A1 | 9/2002 |
| EP | 1647494 | A2 | 4/2006 |
| GB | 2391532 | A | 8/2002 |
| GB | 2374580 | A | 10/2002 |
| GB | 2414958 | A | 6/2004 |
| WO | 9712539 | A1 | 4/1997 |
| WO | 2005058700 | A | 6/2005 |
| WO | 2006081858 | A1 | 8/2006 |

* cited by examiner

*Primary Examiner* — Jason K Niesz

(74) *Attorney, Agent, or Firm* — Troutman Sanders LLP; Ryan A. Schneider; Elizabeth-Ann Weeks

(57) ABSTRACT

The use of a container in an automatic dishwasher. The container is shaped such that it has a maximum width of less than 40 mm.

14 Claims, 2 Drawing Sheets

CONTAINER

This is an application filed under 35 USC 371 of PCT/GB2009/000099.

The present invention relates to the use of a container.

Containers can be used for release of actives into automatic dishwashers. These containers typically have dispersible closures which disperse at a point in the washing cycle, with dispersion commonly triggered by heat causing melting of the closure material, typically a paraffin wax. Obviously for best release of the contents of the containers the dispersible plug has to be placed at the lowest point of the container so that dispersion can occur under gravity.

One main problem associated with this use is the placement of the container. The container needs to be placed in a secure locus where it will not cause problems with the operation of the dishwasher and where it will be able to release the actives contained therein.

Also it has to be placed in a locus where the dispersible closure is not prematurely dispersed. This can be an issue, if the dispersible closure is brought into contact with a hot surface of the automatic dishwasher. Additionally the closure has to be located such that it is not ruptured when the consumer is loading/unloading or otherwise interacting with the dishwasher.

The preferred placement area has been in the cutlery basket of the dishwasher.

A problem arises where the dishwasher does not have a conventional cutlery basket (wherein the cutlery is orientated in an upright manner). This is now an issue in an increasing number of machines that now have cutlery trays (wherein the cutlery is orientated in a horizontal manner). These trays do not suit the location of a dispensing container as they cannot securely retain such a container.

An object of the present invention is to obviate/mitigate the problems outlined above.

According to a first aspect of the invention there is provided the use of a container in an automatic dishwasher wherein the container is shaped such that it has a maximum width of less than 40 mm.

An advantage of the present invention is that in use the container can be placed within a crockery rack of an automatic dishwasher. This allows for greater flexibility in the number of loci of placement of the container, especially in that the container does not require its own bespoke place for placement. Additionally by placement of the container with a crockery rack (between the pins of same) supplementary stability is offered to the container which eliminates the risk of damage to the dishwasher and any dishwasher contents.

Preferably the maximum width of the container is less than 35 mm, more preferably the maximum width is less than 25 mm or less than 22 mm.

In one embodiment the container is shaped such that its maximum width is at or near the centre of the largest face of the container (the face having the two largest measurements, typically the length and height of the front face). In this case the container may be profiled so that container is narrower moving away from the centre. For example for a container having a maximum central width in the range of 30 mm-40 mm, an edge or all edges of the container may have a preferred maximum width of 22-25 mm.

In an alternative embodiment the container may have a largely constant width across the entire length of the container. For example for a container having a maximum central width in the range of 22 mm-25 mm, an edge or all edges of the container may have a preferred maximum width of 22-25 mm.

Preferably the container has a minimum length of 100 mm and more preferably more than 130 mm. Preferably the container has a maximum length of 200 mm. This allows for facile placement in a crockery rack of an automatic dishwasher.

As such the maximum width:length ratio of the container is preferably less than 1:3.

Preferably the container has a maximum height of up to 300 mm, more preferably less than 200 mm, and most preferably between 100 and 150 mm.

Considering the preferred dimensions for the height and length of the container it can be seen that a preferred shape of the container is based on a square/rectangular cuboid. The edges of the shape are preferably curved for ease of use.

The container may have a filling/emptying means, e.g. a neck. The neck is preferably disposed on a small face of the container, preferably the neck being substantially parallel to the height axis and the small face being substantially perpendicular to the height axis. Generally the neck is centrally disposed on this face. The neck is preferably circular. The neck may have an associated screw thread and cap to allow closing and opening of the container. The neck may have a collar where it meets the face. Generally for ease of placement and to prevent any interference with the operation of the dishwasher (particularly with any moving parts thereof) the neck (including cap) has a maximum height of about 25 mm.

The face of the container where the neck is located is preferably flat, in order to ensure stable placement in the crockery rack of the dishwasher.

The face of the container opposite to the neck is preferably flat, in order to ensure stable placement during transport. For the same reasons the width of the container about the face opposite the neck is generally wider than the remainder of said face. Preferably this position of the face has a maximum central width in the range of 30-40 mm.

As strengthening aids and/or as location aids (e.g. to prevent movement during dishwasher operation such as when moving the crockery rack to load/unload items), whilst not hindering the facile placement of the container in the crockery rack, the container may have one or more protrusions. These protrusions, where present, may be in the form of bulbous extensions, for example at an apex of the container or may be disposed as projections on a face of the container. Most preferably each apex of the container has such a bulbous extension. Preferably the face of the container opposite the neck has a projection. Where present the protrusions do not extend any dimension of the container above those specified above.

Where present the difference in width between the face to which the protrusion is attached/incorporated and the protrusion is preferably at least 1 mm, preferably more than 3 mm. Generally the width of the protrusion is between 20 mm and 40 mm, most preferably between 23 mm and 35 mm. Generally the length of the protrusion is more than 5 mm, preferably more than 10 mm.

Generally the container is formed of a deformable material for ease of placement. A suitable material is a plastics material such as a polyester or a polyolefin (e.g. polyethylene/polypropylene).

Preferably the container is for use in the application of a liquid formulation to an automatic dishwasher, e.g. a liquid detergent such as a dishwasher machine cleaner. Such a formulation is described in European application EP-A-1824755, the contents of which are incorporated by reference. As such the container may, in use, be orientated with the neck facing downwards and wherein the neck incorporates a plug which is dissipated in operation of the dishwasher to release the contents of the container.

The invention will now be described with reference to the following non-limiting Figures, in which:-

Figure 1:
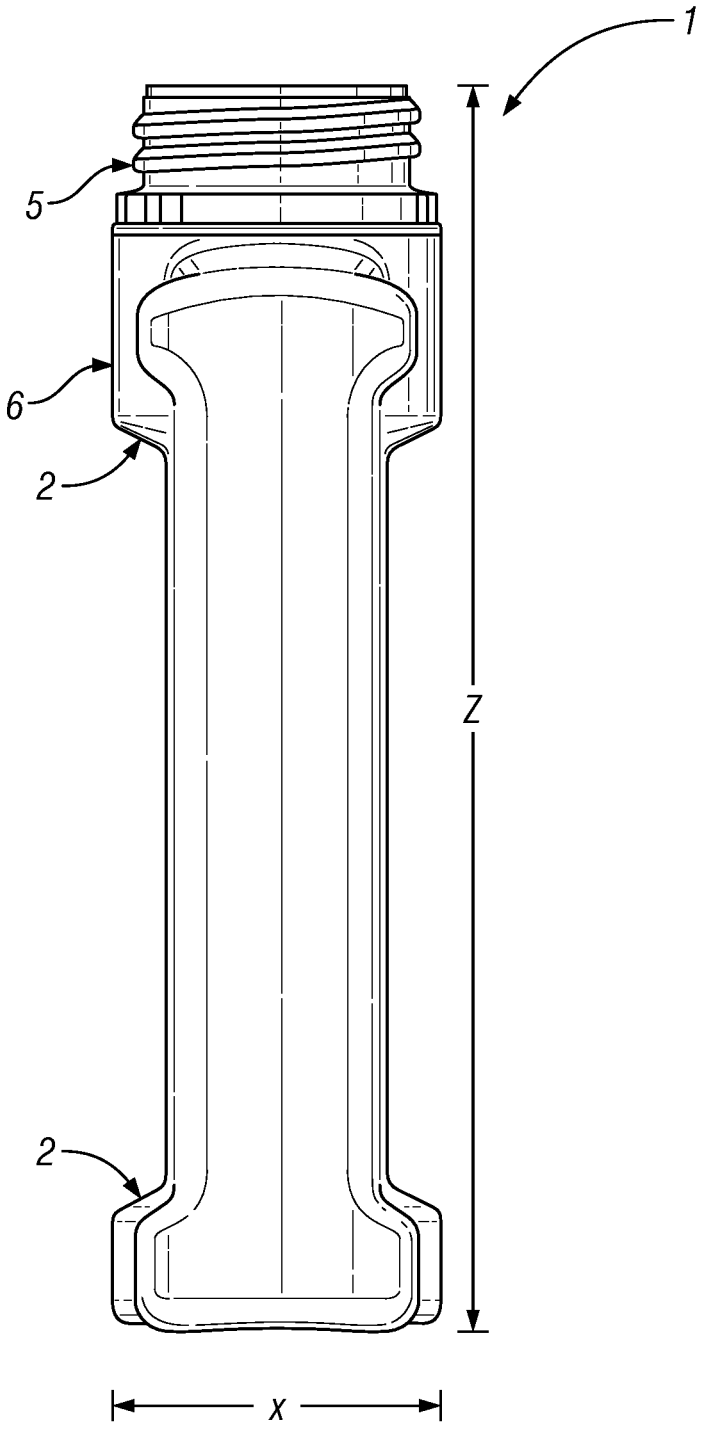
FIG. 1 is a view of a container in accordance with the invention.
Figure 2:
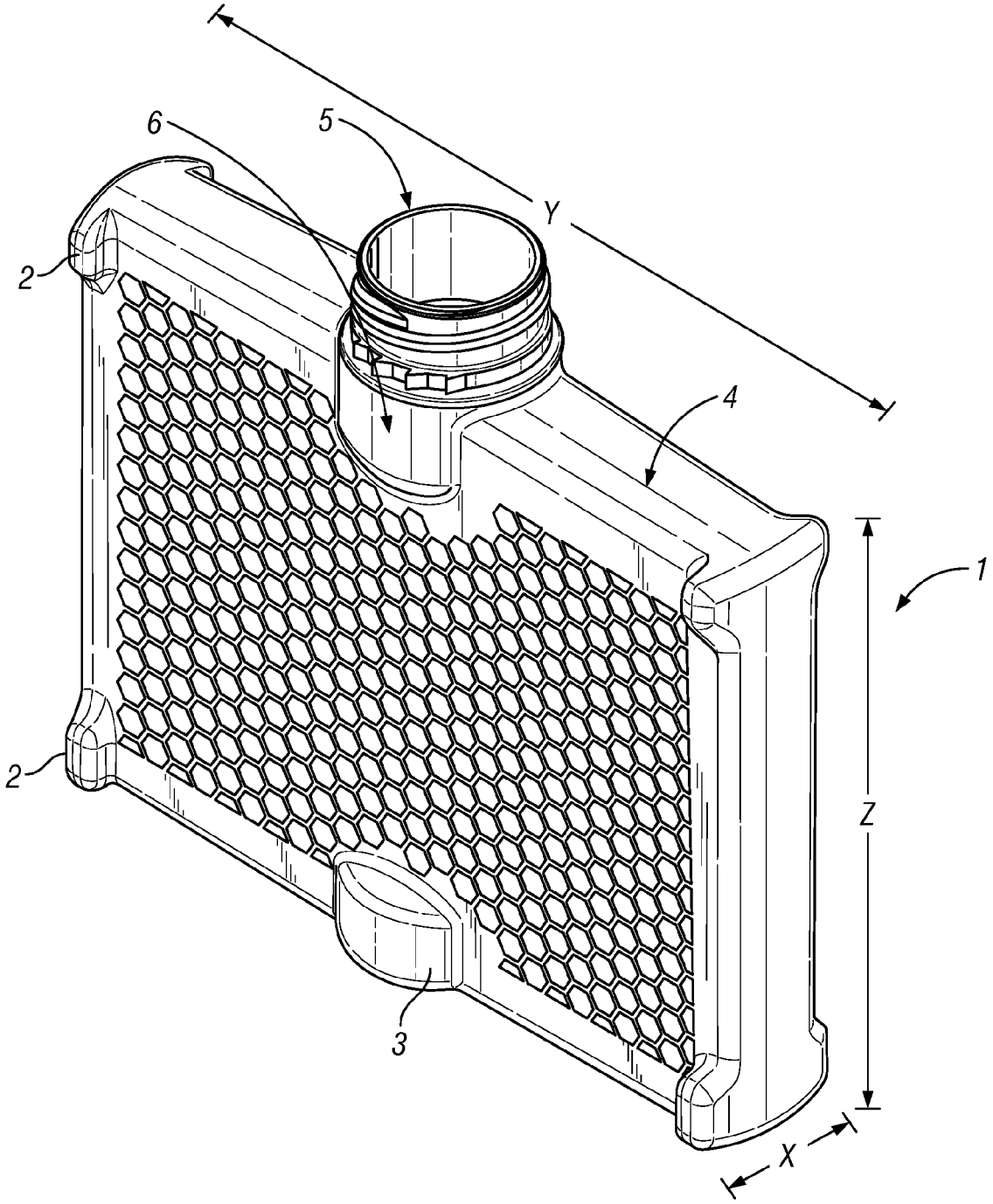
FIG. 2 is an alternative view of a container in accordance with the invention.

FIGS. 1 and 2 show the container 1. The container is a rectangular cuboid. The cuboid is shaped such that it has a maximum width (x) of 35 mm, a minimum width of 19 mm and an average width of 22 mm, a length (y) of 135 mm and a height, including the cap, (z) of 125 mm.

The apices of the cuboid are in the form of bulbous protrusions 2. A projection 3 is disposed adjacent a lower edge of the container 1.

In the centre of an upper face 4 is disposed a neck 5. The neck 5 is adjoined to the upper face 4 and has an associated collar 6. The neck 5 has a thread for attachment of a screw-cap (not shown).

The invention claimed is:

1. A method of applying a liquid dishwasher machine cleaner detergent to the interior of an automatic dishwasher during a washing cycle of the dishwasher, the method comprising the steps of:

providing a container which contains a quantity of the liquid detergent within the container, wherein the container is shaped such that it has a maximum width of less than 40 mm and a minimum length of 100 mm, inserting the container to the interior of the automatic dishwasher between the pins of a crockery rack therein, such that the pins stabilize the location of the container inside the dishwasher during the washing cycle, and releasing the liquid detergent from within the container into the interior of the automatic dishwasher during the washing cycle;

wherein the container comprises one or more apexes and one or more protrusions, and wherein the one or more protrusions are in the form of a bulbous extension at the one or more apexes.

2. A method according to claim 1, wherein the container is shaped such that its maximum width is at or near the center of the largest face of the container.

3. A method according to claim 1, wherein an edge of the container has a maximum width of less than 25 mm.

4. A method according to claim 1, wherein the container has a maximum height of up to 300 mm.

5. A method according to claim 1, wherein the container has a neck.

6. A method according to claim 5, wherein the neck has a maximum length of about 25 mm.

7. A method according to claim 1, wherein the container has more than one protrusion.

8. A method according to claim 1, wherein the container is formed of a deformable material.

9. A method according to claim 3, wherein an edge of the container has a maximum width of less than 22 mm.

10. A method according to claim 4, wherein the container has a maximum height of less than 200 mm.

11. A method according to claim 10, wherein the container has a maximum height of between 100 mm and 150 mm.

12. A method according to claim 1, wherein the maximum width:length ratio of the container is less than 1:3.

13. A method according to claim 1, wherein the container comprises a projection in the form of an extension at a lower edge of the container.

14. A method of applying a liquid dishwasher machine cleaner detergent to the interior of an automatic dishwasher during a washing cycle of the dishwasher, the method comprising the steps of:

providing a container which contains a quantity of the liquid detergent within the container, wherein the container is shaped such that it has a maximum width of less than 40 mm and a minimum length of 100 mm, inserting the container to the interior of the automatic dishwasher between the pins of a crockery rack therein, such that the pins stabilize the location of the container inside the dishwasher during the washing cycle, and releasing the liquid detergent from within the container into the interior of the automatic dishwasher during the washing cycle;

wherein the container comprises a projection in the form of an extension at a lower edge of the container.

* * * * *